United States Patent [19]

Bar

[11] 4,099,154

[45] Jul. 4, 1978

[54] STARTING RELAY CASING FOR MOTORCOMPRESSORS

[75] Inventor: Alfredo Bar, Pavia, Italy

[73] Assignee: NECCHI Societa per Azioni, Pavia, Italy

[21] Appl. No.: 809,760

[22] Filed: Jun. 24, 1977

[30] Foreign Application Priority Data

Jul. 2, 1976 [IT] Italy ..... 42910 A/76

[51] Int. Cl.[2] ..... H01C 13/00; H01C 7/02

[52] U.S. Cl. ..... 338/220; 338/22 R

[58] Field of Search ..... 338/220, 22 SD, 22 R; 29/612, 613; 318/471, 473

[56] References Cited

U.S. PATENT DOCUMENTS

| | | | |
|---|---|---|---|
| 3,737,752 | 6/1973 | Strachan | 338/220 X |
| 3,750,082 | 7/1973 | Petersen et al. | 338/220 |
| 3,794,949 | 2/1974 | Larsen et al. | 338/22 R |
| 3,921,117 | 11/1975 | Blaha | 338/220 X |
| 3,955,170 | 5/1976 | Gershecker | 338/220 X |
| 3,988,709 | 10/1976 | McKinnon et al. | 338/220 X |

*Primary Examiner*—C. L. Albritton

*Attorney, Agent, or Firm*—Stevens, Davis, Miller & Mosher

[57] ABSTRACT

Starting relay casing of molded plastic material for a monophase motor of a motorcompressor assembly for refrigerating apparatuses, comprising a bottom wall and a side wall attached thereto, fitting within said walls, a lower contact plate having three vertexes uniformly distributed about the periphery thereof to which are attached three feet, a positive temperature coefficient resistance having a disc shape resting on said lower plate and an upper contact plate closing said casing and pressing against the upper surface of said disc, said side wall defining on the inside thereof, at a predetermined distance from said bottom wall, three ledges upon which may rest said three feet, said side wall also defining spaces therein for said feet to rest directly on said bottom wall, when said lower plate is alternatively positioned.

1 Claim, 6 Drawing Figures

STARTING RELAY CASING FOR MOTORCOMPRESSORS

The present invention relates to a starting relay casing for motorcompressors for refrigerating apparatuses of the type using a positive temperature coefficient resistance. The resistances of the type mentioned above, used on household refrigerators, are usually put on the market as discs, of two types, in which one differs from the other in diameter and thickness, according to the tension of the supply mains.

These discs are placed in a casing with their conducting circular surfaces held between two contact plates, a lower and an upper one, each of which is provided with a terminal projecting from the same casing.

An object of the present invention is to provide a single casing, suitable to contain one disc or the other interchangeably. The technical problem to be solved in order to attain the aim mentioned, was to provide a particular configuration of the casing and of the conducting plates which allow the discs to be fastened inside the casing and perfect conducting conditions in each of the two alternative applications.

The resolution of the technical problem is characterized in that the casing, formed by a bottom wall and a side wall, has inside thereof, at a stated height from the bottom wall, three ledges on which lie three feet extending from the lower contact plate. The feet are able to rest directly on the bottom wall, when the lower plate is positioned in a different way.

Further advantages and characteristics will become apparent from the following description of a preferred non-limiting embodiment of the relay casing and from the attached drawings in which.

Figure 1:
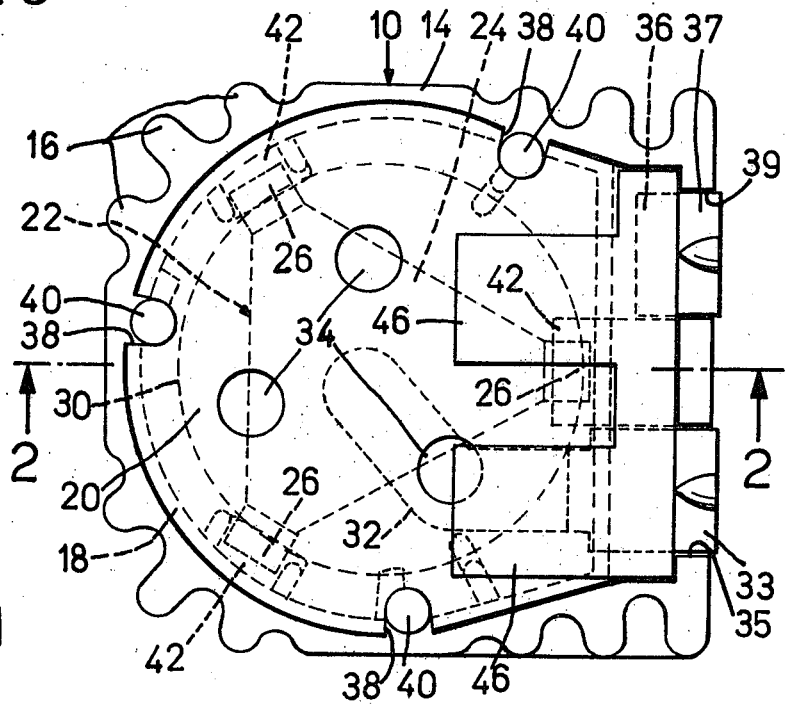
FIG. 1 is a plan view of the starting relay and its casing.
Figure 5:
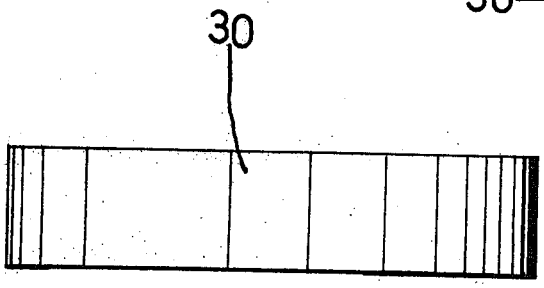
FIGS. 5 and 6 show the two resistances used.
Figure 6:
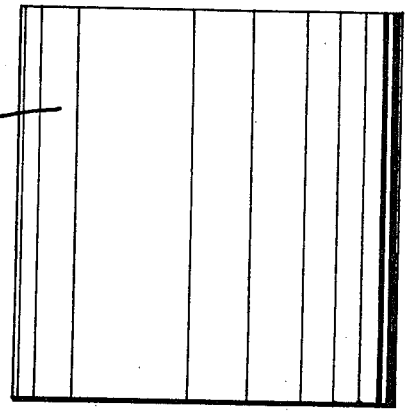

In FIG. 1 casing 10 contains the starting relay of a monophase motor of a motorcompressor for refrigerating apparatuses.

Figure 3:
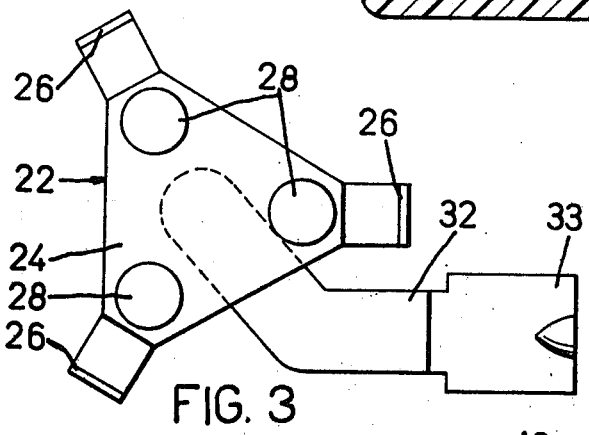
FIG. 3 shows a member of the relay of FIG. 1.

It is made of molded plastic material and is formed by a bottom wall 12 and a side wall 14 provided with fins 16. All along the upper portion of side wall 14, is a seat 18 for seating conducting plate 20 which closes casing 10. Within casing 10 is placed a contact plate 22 (FIG. 3). Contact plate 22 is formed by a triangle shaped central body 24 and by three feet 26 each placed on one of three vertexes. Onto central body 24 are projected three curved substantially hemispherical surfaces 28 which ensure a perfect contact with the lower surface of circular disc 30 forming the positive temperature coefficient (P.T.C.) resistor. A terminal 32, fixed by welding or other process, to contact plate 22, projects with its free end 33 from casing 10 through an opening 35 in wide wall 14. Disc 30 is positioned over contact plate 22 and is kept in contact with surfaces 28 by means of an upper plate 20 pressing on the upper circular surface of disc 30 by means of three small curved substantially hemispherical surfaces 34 similar to surfaces 28 of lower contact plate 22.

Under upper plate 20 is fixed a second terminal 36 (FIG. 1) which, similarly to terminal 32, projects from casing 10 with its external portion 37 extending through opening 39 of wall 14.

Upper contact plate 20 is provided along its edge, with three semicylindrical notchings 38 fitting about pegs 40, which form an integral part of casing 10.

After positioning plate 20 on casing 10, the ends of said pegs 40 are heated and soldered to plate 20 to ensure its being secured to casing 10. By this operation disc 30 urged by plate 20 also is fixed to casing 10.

According to the invention, lower contact plate 22 can be arranged inside casing 10 on seats placed at different heights from the bottom wall in order to arrange discs 30 and 30' of two different thicknesses considering that the position in heights of contact plate 20 must be kept constant. For this purpose in the inner portion of side wall 14 of casing 10, three ledges 42 are formed about midway of the height of wall 14 on which lay the three feet 26 of lower contact plate 22 when disc 30 of the small thickness is placed in casing 10.

Figure 4:
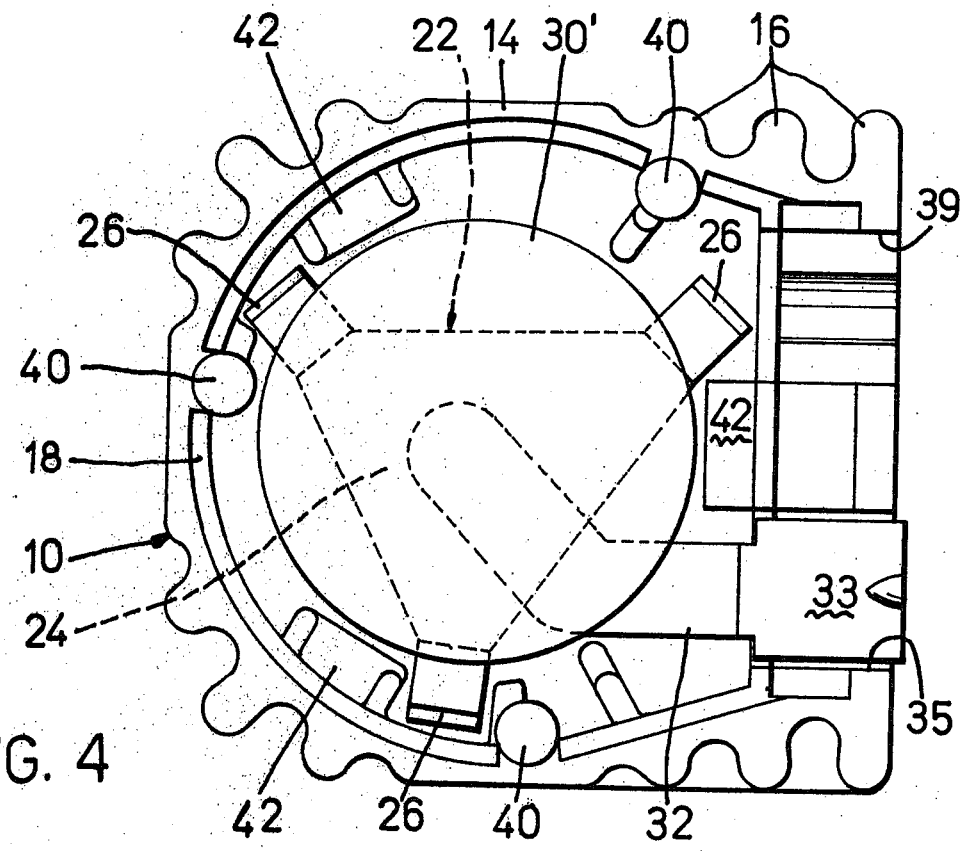
FIG. 4 shows the relay of FIG. 1 in the alternative application.

When the thicker disc 30' is placed in casing 10 (FIG. 4) feet 26 will rest on the bottom of the casing wall 12 in spaces provided between mounting ledges 42 and pegs 40.

Depending upon which disc is used, the positioning of plate 22 is changed in casing 10. However, unchanged is the position of opening 35 of the outlet of terminal 32. Terminal 32 will be soldered to plate 22, according to the disc used, in two different relative positions as clearly shown in FIGS. 1 and 4.

Figure 2:
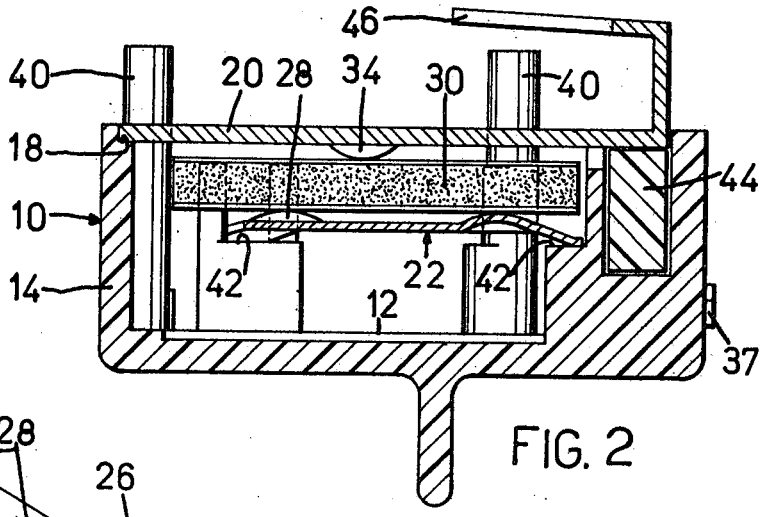
FIG. 2 is a sectional view taken along lines 2—2 of FIG. 1.

In order to fasten the two ends 33 and 37 of terminals 32 and 36 to openings 35 and 39 of wall 14 of casing 10 a small bar 44 is placed transversely over terminals 32 and 36 (FIG. 2). Upper contact plate 20 consists of two quick connecting plugs 46 to connect, in the usual way, the relay to the motor elect layout.

What is claimed is:

1. Starting relay casing of molded plastic material for a monophase motor of motorcompressor assembly for refrigerating apparatuses, comprising a bottom wall and a side wall attached thereto, fitting within said walls, a lower contact plate having three vertexes uniformly distributed about the periphery thereof to which are attached three feet, a positive temperature coefficient resistance having a disc shape resting on said lower plate and an upper contact plate closing said casing and pressing against the upper surface of said disc, said side wall defining on the inside thereof, at a predetermined distance from said bottom wall, three ledges upon which may rest said three feet, said side wall also defining spaces therein for said feet to rest directly on said bottom wall, when said lower plate is alternatively positioned.

* * * * *